United States Patent [19]

Kanamori et al.

[11] Patent Number: 5,058,170

[45] Date of Patent: Oct. 15, 1991

[54] ARRAY MICROPHONE

[75] Inventors: Takeo Kanamori, Takatsuki; Hiroki Furukawa, Osaka; Satoru Ibaraki, Higashiosaka; Michio Matsumoto, Sennan, all of Japan

[73] Assignee: Matsushita Electric Industrial Co., Ltd., Osaka, Japan

[21] Appl. No.: 473,398

[22] Filed: Feb. 1, 1990

[30] Foreign Application Priority Data

Feb. 3, 1989 [JP] Japan ..... 1-25012

[51] Int. Cl.[5] ..... H04R 3/00

[52] U.S. Cl. ..... 381/92; 381/94

[58] Field of Search ..... 381/92, 93, 94; 3647/123, 124, 126, 129

[56] References Cited

U.S. PATENT DOCUMENTS 4,536,887 8/1985 Kaneda et al. ..... 381/94

4,683,590 7/1987 Miyoshi et al. ..... 381/94

4,696,043 9/1987 Iwahara et al. ..... 381/92

*Primary Examiner*—Jin F. Ng

*Assistant Examiner*—Sylvia Chen

*Attorney, Agent, or Firm*—Wenderoth, Lind & Ponack

[57] ABSTRACT

An array microphone is a directional microphone having an improved directional characteric in which both the sensitivity and the sound pressure frequency response are uniform within the recording area and more particularly, the quality and level of sound remain unchanged. The array microphone includes a microphone array including a plurality of microphone units, and a two-dimensional filter for filtering an output of the microphone array in the dimensions of both time and space. When the two-dimensional filter is a digital filter and varied in its two-dimensional filter coefficient and sampling frequency, the array microphone serves as a variable directional microphone whose directional characteristic can be varied with the sound quality and level remaining unchanged throughout the recording area.

12 Claims, 6 Drawing Sheets

ARRAY MICROPHONE

BACKGROUND OF THE INVENTION

1. Field of the Invention

The present invention relates to an array microphone having a plurality of microphone units arranged to form a microphone array.

2. Description of the Prior Art

An array microphone which has an enhanced directional characteristic, has widely been employed for remote recording with a high S/N ratio and for acoustic feedback suppression or elimination of howl effects generated by a loudspeaker system.

Such a known array microphone comprises a microphone array consisting of a plurality of microphone units, a plurality of delay circuits for delaying output signals of the respective microphone units, a plurality of signal amplifier circuits for weighting outputs of the respective delay circuits, and an adder circuit for summing outputs of the amplifier circuits. The output of the adder circuit is an output of the array microphone.

In the prior art array microphone, the direction of sound recording is controlled by the delay circuits and the output of each microphone unit is weighted by the corresponding signal amplifier circuit. This serves as a spatial filter for controlling the directional characteristic such that the main lobe is directed in a desired direction.

This type of directional characteristic has a nature of frequency dependence, i.e. it will be sharp when the frequency is high. Therefore, there is a disadvantage in that slight movement of a speaker during recording causes a great change in the sound quality. In a conventional method of sound recording with a moving speaker, a plurality of line microphones oriented in different directions are selectively switched according to the movement of the speaker or the direction of each line microphone is mechanically controlled. However, such manners require bulky and complicated hardware and are thus less practical. On the other hand, the conventional directional microphone has a fixed directional characteristic which is not adjustable to a desired directional characteristic for specific use and thus must be utilized in combination with different types of microphones including uni-directional types, bi-directional types, etc.

SUMMARY OF THE INVENTION

An object of the present invention is to provide an array microphone having an improved directional characteristic which is not frequency dependent and is variable for desired applications, ensuring no change in the sound quality and level when a speaker moves about within a recording area. In the directional characteristic, a "recording area" is defined as a particular angle range in which adequately high sensitivity including the maximum sensitivity is obtained. A "dead zone" is defined as an angle range in which the sensitivity is adequately lower relative to that in the recording area.

To achieve the above object, an array microphone according to the present invention comprises a microphone array having a plurality of microphone units and a two-dimensional filter coupled to the microphone array for filtering outputs of the microphone array in the dimensions of both time and space simultaneously. Preferably, the two-dimensional filter is a digital filter. The array microphone of the present invention may further comprises a coefficient change circuit for changing a filter coefficient of the two-dimensional filter and a sampling frequency control circuit for varying the sampling frequency of the two-dimensional filter.

Accordingly, the two-dimensional process of a signal can be executed on the time axis referring to a time change in the signal output of the microphone array and along the space axis referring to a spatial change in the signal output of the microphone array. As the result, the array microphone of the present invention has an improved directional characteristic involving no frequency dependence and thus, ensuring no change in the sound quality and level during the movement of a speaker within the recording area. Also, the directional characteristic can be changed in shape by changing the filter coefficient in the two-dimensional filter. Furthermore, the recording area can be changed by varying the sampling frequency. The details of the operation will be described.

Assuming that the direction of the arrangement of the microphone array is expressed as $\theta=0°$ on a two-dimensional frequency plane defined by two perpendicularly crossing frequency axes of a time frequency f1 and a space frequency f2 with respect to time and spatial changes in the output of the microphone array respectively, the frequency spectrum of a sound wave detected by the microphone array is represented by:

$$f2=f1\cdot d\cdot\cos(\theta)/(T\cdot c) \tag{1}$$

where T is a cycle period of sampling, d is a distance between two adjoined microphone units, and c is a velocity of sound.

The two-dimensional filter may have a pass range expressed by the following formula (2), (e.g. a fan filter described in "On the practical design of discrete velocity filters for seimic data processing" by K. L. Peacock, IEEE Trans. Acoust., Speech & Signal Process., ASSP-30, 1, pp. 52–60 in Feb., 1982), or may have any one of the pass ranges expressed by the following formulas (3) to (7):

$$|f2|<|f1| \tag{2}$$

$$|f2|>|f1| \tag{3}$$

$$|f2|>|f1| \text{ and } f1\times f2>0 \tag{4}$$

$$|f2|>|f1| \text{ and } f1\times f2<0 \tag{5}$$

$$|f2|<|f1| \text{ and } f1\times f2>0 \tag{6}$$

$$|f2|<|f1| \text{ and } f1\times f2<0 \tag{7}$$

Recording areas expressed by the following formulas (8) to (13) can be obtained by applying the equation (1) to the formulas (2) to (7), respectively:

$$\begin{gathered}90° - \cos^{-1}(T\cdot c/d) \leqq \theta \leqq 90° + \cos^{-1}(T\cdot c/d)\\ 270° - \cos^{-1}(T\cdot c/d) \leqq \theta \leqq 270° + \cos^{-1}(T\cdot c/d)\\ -\cos^{-1}(T\cdot c/d) \leqq \theta \leqq \cos^{-1}(T\cdot c/d)\end{gathered} \tag{8}$$

$$180° - \cos^{-1}(T\cdot c/d) \leqq \theta \leqq 180° + \cos^{-1}(T\cdot c/d) \tag{9}$$

$$-\cos^{-1}(T\cdot c/d) \leqq \theta \leqq \cos^{-1}(T\cdot c/d) \tag{10}$$

$$\begin{gathered}180° - \cos^{-1}(T\cdot c/d) \leqq \theta \leqq 180° + \cos^{-1}(T\cdot c/d)\\ \cos^{-1}(T\cdot c/d) \leqq \theta \leqq 90°\end{gathered} \tag{11}$$

-continued $$270^\circ \leqq \theta \leqq 360^\circ - \cos^{-1}(T \cdot c/d) \quad (12)$$
$$90^\circ \leqq \theta \leqq -\cos^{-1}(T \cdot c/d)$$

$$180^\circ + \cos^{-1}(T \cdot c/d) \leqq \theta \leqq 270^\circ \quad (13)$$

The above formulas (8) to (13) contain no variable corresponding to the frequency and thus, a directional characteristic having no frequency dependence is established. It is understood that the formulas (8) to (13) demonstrate examples of the directional characteristics each of which can be obtained by changing the two-dimensional filter coefficient with a coefficient change circuit. It is also apparent from the formulas (8) to (13) that the recording area can be varied by changing the sampling frequency fs (=1/T) with a sampling frequency control circuit.

According to the present invention, as set forth above, there are provided in combination a microphone array having a plurality of microphone units and a two-dimensional filter for filtering outputs of the microphone array in the dimensions of time and space at one time, so that the improved directional characteristic is obtained which has no frequency dependence and ensures no change in the sound quality and level during the movement of a speaker within the recording area. Preferably, the two-dimensional filter is a digital filter. Also, with addition of a coefficient change circuit for changing the coefficient of the two-dimensional filter and a sampling frequency control circuit for varying the sampling frequency of the two-dimensional filter, the directional characteristic can be arbitrarily varied.

DESCRIPTION OF THE PREFERRED EMBODIMENTS

Figure 1:
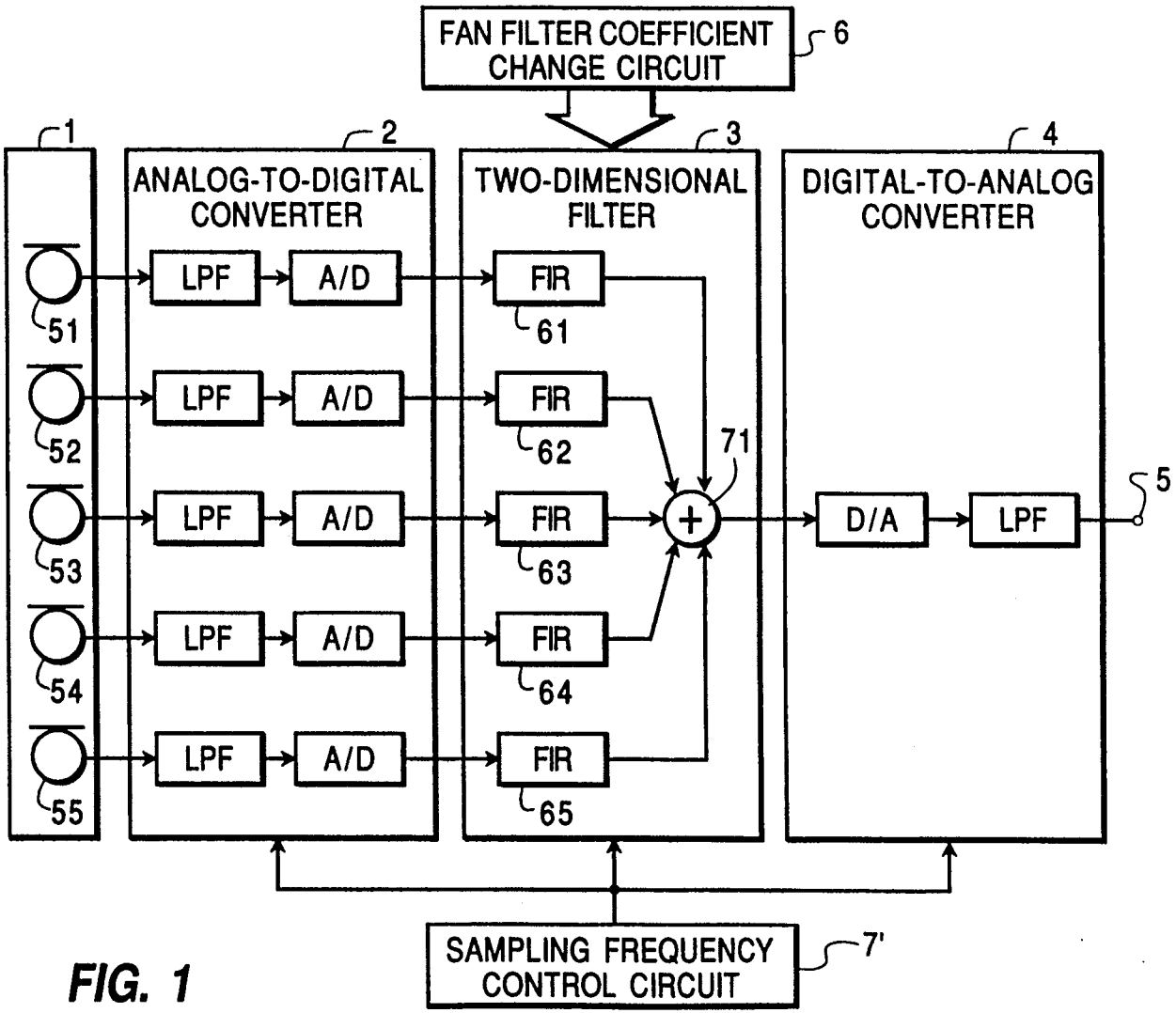
FIG. 1 is a schematic view of an array microphone according to a first embodiment of the present invention.

A first embodiment of the present invention will be described in the form of an array microphone referring to the accompanying drawings. FIG. 1 illustrates the array microphone according to the first embodiment in which elements 51 to 55 are omni-directional microphone units. The omni-directional microphone units 51 to 55 are provided in a linear arrangement constituting a microphone array 1. Elements 2 is an analog-to-digital (A/D) converter circuit which converts analog signals from the respective omni-directional microphone units 51 to 55 in the microphone array 1 to digital signals. The A/D converter circuit 2 comprises a plurality of low-pass filters (LPF) each removing a high frequency component from an output signal of a corresponding microphone unit and a plurality of analog-to-digital converters (A/D) for converting outputs of the respective LPFs to digital signals. Elements 61 to 65 are FIR filters and elements 71 is an adder circuit. A two-dimensional filter 3 is constituted by the FIR filters 61 to 65 receiving output signals from the A/D converter circuit 2 and the adder circuit 71 for summing output signals from the FIR filters 61 to 65 to obtain a composite digital signal. Element 4 is a digital-to-analog (D/A) converter circuit for converting the digital signal from the two-dimensional filter 3 into an analog signal which is outputted from a terminal 5. A coefficient change circuit 6 is also provided for changing a filter coefficient of the two-dimensional filter 3 and a sampling frequency control circuit 7 is also provided for varying the sampling frequencies of the A/D converter circuit 2, two-dimensional filter 3, and D/A converter circuit 4.

Figure 2:
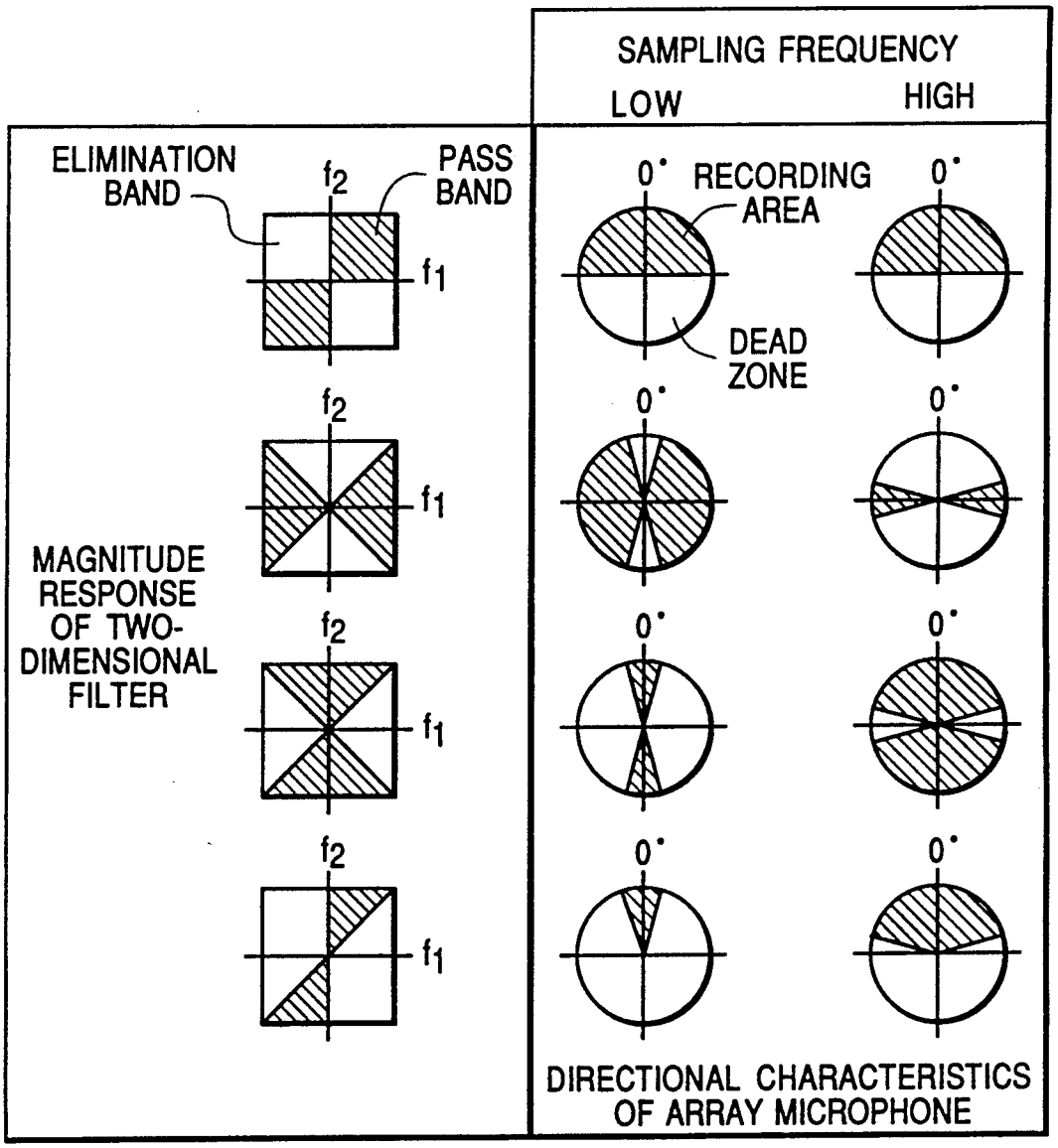
FIG. 2 is a diagram showing the directional characteristics of the array microphone according to the first embodiment of the present invention.

The operation in the array microphone having the foregoing arrangement will then be explained. A sound wave picked up by the microphone array 1 is converted to electrical signals by the omni-directional microphone units 51 to 55 of the microphone array 1 and transferred to the A/D converter circuit 2. The analog signals from the microphone array 1 are then converted by the A/D converter circuit 2 into digital signals which are in turn sent to the two-dimensional filter 3. The digital signals from the A/D converter circuit 2 are filtered in the dimensions of both time and space by the two-dimensional filter 3 and then, a filtered digital signal is transferred to the D/A converter circuit 4. The digital output from the two-dimensional filter 3 is converted to an analog signal by the D/A converter circuit 4. The coefficient change circuit 6 is arranged for varying the filter coefficient in the two-dimensional filter 3 to change the directional characteristic of the array microphone. The sampling frequency control circuit 7 is provided for changing the sampling frequencies of the A/D converter circuit 2, the two-dimensional filter 3, and the D/A converter circuit 4 respectively to vary the range of the recording area. FIG. 2 shows the relationships among the microphone directional characteristic, the sampling frequency varied by the sampling frequency control circuit 7, and the two-dimensional filter magnitude frequency response using a two-dimensional filter coefficient supplied from the coefficient change circuit 6 to the two-dimensional filter 3. Although the microphone array 1 in the embodiment consists of omni-directional microphone units arranged linearly at equal intervals, it may be constructed with a plurality of directional microphone units.

Accordingly, the combined arrangement of the microphone array comprising a row of microphone units and the two-dimensional filter adapted for filtering the output signal of the microphone array in the dimensions of both time and space at a time upon receiving the same as an input signal, can provide an improved directional characteristic which has no frequency dependence and ensures no change in the sound quality and level even when a speaker moves about within the recording area. Preferably, the two-dimensional filter is a digital filter. Also, with an additional arrangement of the coefficient change circuit for varying a filter coefficient of the two-dimensional filter and the sampling frequency control circuit for varying the sampling frequency of the two-dimensional filter, the directional characteristic can be varied according to its use.

Figure 3:
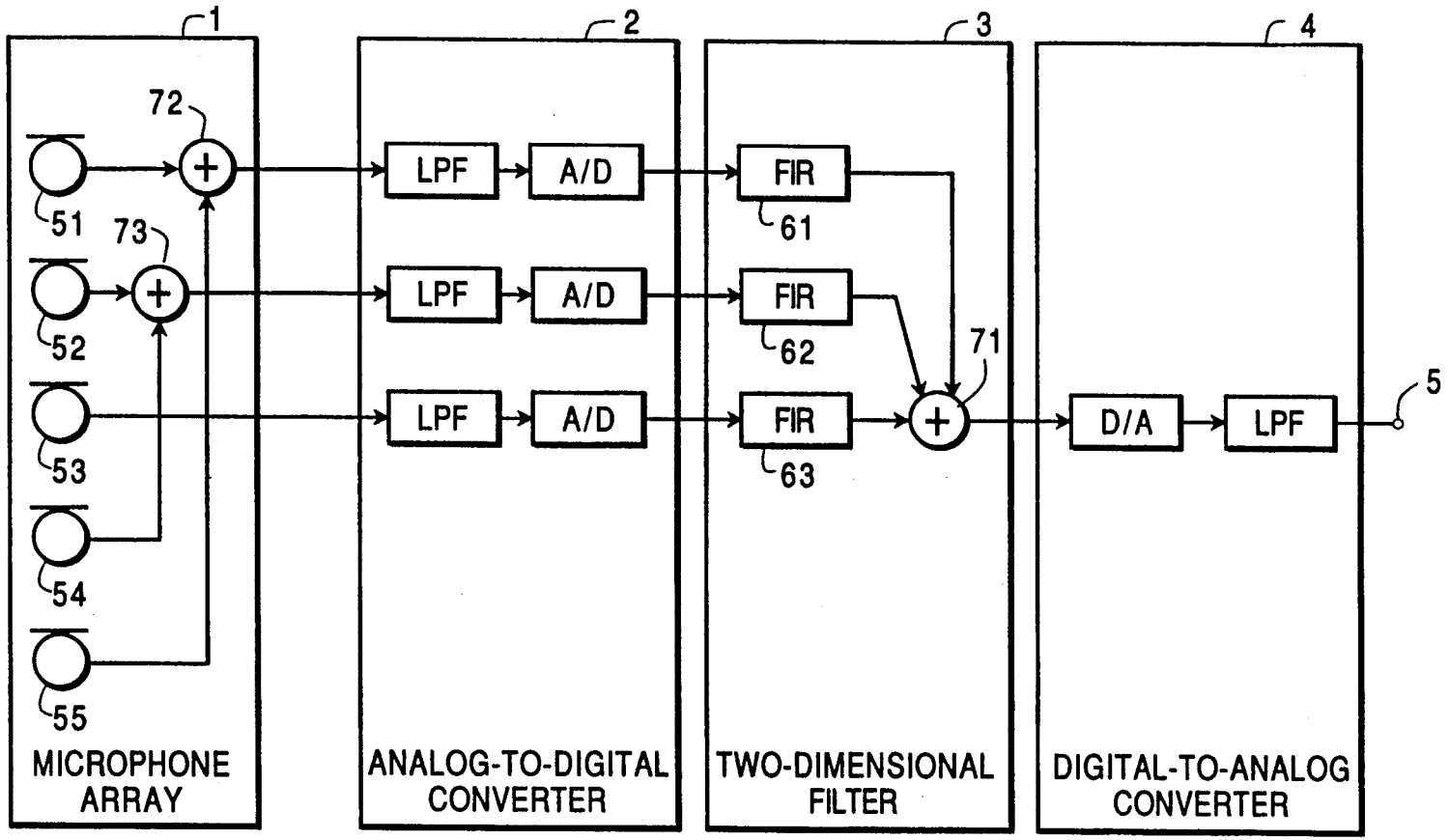
FIG. 3 is a schematic view of an array microphone according to a second embodiment of the present invention.

A second embodiment of the present invention will be described in conjunction with the drawings. FIG. 3 illustrates an array microphone according to the second embodiment in which elements 51 to 55 are an odd number of omni-directional microphone units linearly arranged at equal intervals from the unit 51 to 55. Element 72 is an adder circuit for summing the outputs of the two omni-directional microphone units 51 and 55. Similarly, another adder circuit 73 is provided for summing the outputs of the two omni-directional microphone units 52 and 54. The omni-directional microphone units 51 to 55 and both the adder circuits 72 and 73 constitute in combination a microphone array 1 which delivers outputs from the adder circuits 72 and 73 and the omni-directional microphone unit 53. An A/D converter circuit 2 is provided for converting the analog outputs from the microphone array 1 into digital signals. FIR filters 61 to 63 and an adder circuit 7 constitute a two-dimensional filter 3. Accordingly, the digital outputs from the A/D converter circuit 2 are fed to the FIR filters 61 to 63. Filtered outputs from the FIR filters are added by the adder circuit 7. The digital output from the two-dimensional filter 3 is then converted back into an analog signal by a digital-to-analog (D/A) converter circuit 4, and outputted from a terminal 5.

Figure 4A:
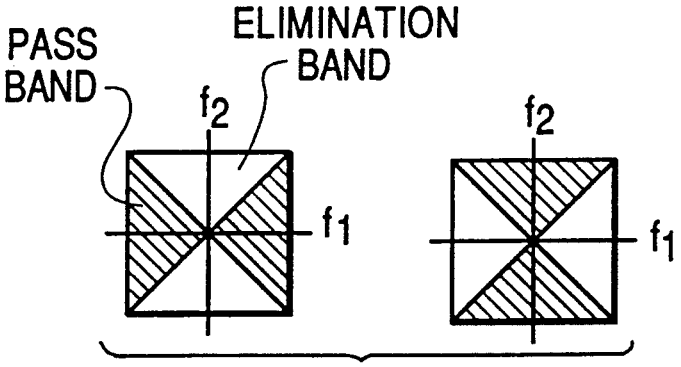
FIGS. 4(*a*)–4(*b*) are diagrams showing the directional characteristics of the array microphone according to the second embodiment of the present invention.
Figure 4B:
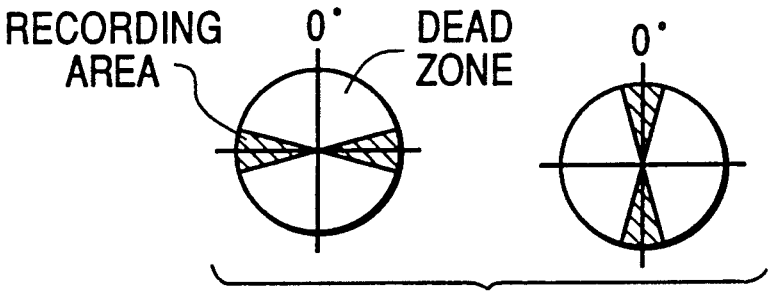

The operation in the array microphone having the foregoing arrangement will be described. The principle of the operation is similar to that of the first embodiment. Such particular directional characteristics as shown in FIG. 4(*b*) can be obtained in a more simple manner according to the second embodiment. FIG. 4(*a*) shows the magnitude response of the two-dimensional filter corresponding to the characteristics of FIG. 4(*b*). To have this magnitude response in the first embodiment, both the FIR filters 61 and 65 should have the same FIR filter coefficient. Also, the FIR filters 62 and 64 have the same FIR filter coefficient. Accordingly, the directional characteristic of the microphone array can be created in the second embodiment by summing with the adder circuit 72 the outputs from the omni-directional microphone units 51 and summing 55 and with the adder circuit 73 the outputs from the omni-directional microphone units 52 and 54 prior to the same processing as in the first embodiment with the A/D converter circuit 2, the two-dimensional filter 3, and the D/A converter circuit 4.

According to the second embodiment, the microphone array 1 of the first embodiment is replaced in the arrangement by the combination of an odd n-number of linearly arranged microphone units and adder circuits for summing the outputs of the i-th and $(n-i+1)$-th microphone units, where $1 \leqq i \leqq (n-1)/2$. This allows the entire circuitry system to be reduced in size and ensures an improved directional characteristic which has no frequency dependence and causes no change in the sound quality and level when a speaker moves about within the recording area.

Figure 5:
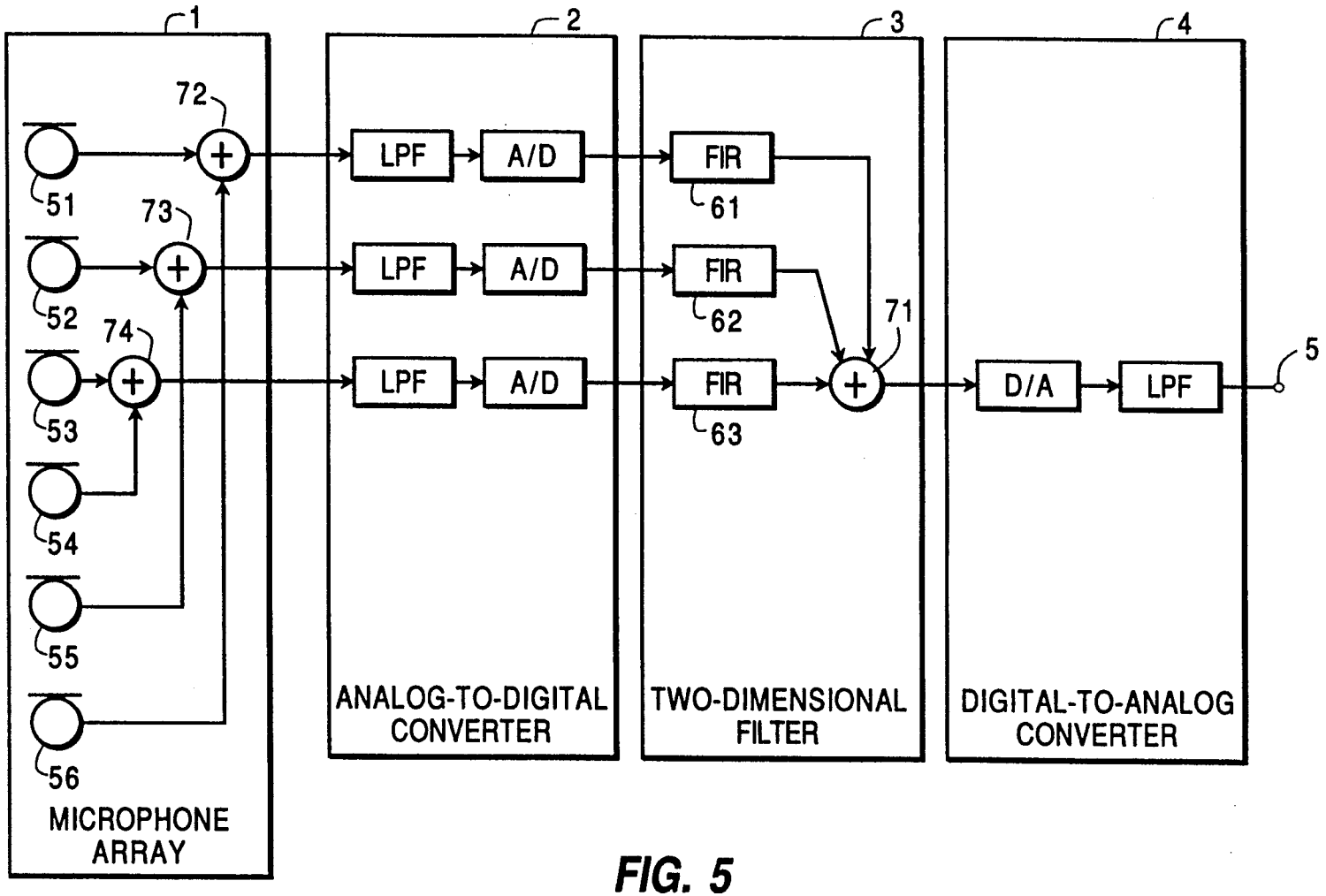
FIG. 5 is a schematic view of an array microphone according to a third embodiment of the present invention.

A third embodiment of the present invention will then be described in conjunction with the drawings. FIG. 5 illustrates an array microphone according to the third embodiment in which the microphone array 1 of the second embodiment is changed in the arrangement while the other components remain unchanged. Elements 51 to 56 are an even number of omni-directional microphone units linearly arranged at equal intervals from the unit 51 to unit 56. Elements 72 is an adder circuit for summing the outputs of the two omni-directional microphone units 51 and 56. Adder circuits 73 and 74 are also provided for summing the outputs of the omni-directional microphone units 52 and 55, and 53 and 54, respectively. The omni-directional microphone units 51 to 56 and the adder circuits 72, 73, and 74 constitute in combination a microphone array 1 which delivers outputs from the adder circuits 72, 73, and 74.

The operation in the array microphone having the foregoing arrangement will be explained. In the microphone array 1, the outputs of the omni-directional microphone units 51 and 56 are summed by the adder circuit 72, the outputs of the units 52 and 55 by the adder circuit 73, and the outputs of the units 53 and 54 by the adder circuit 74. The following process with an A/D converter circuit 2, a two-dimensional filter 3, and a D/A converter circuit 4, is the same as in the first embodiment, providing an equal directional characteristic in the microphone array.

According to the third embodiment, the microphone array 1 of the first embodiment is changed in the arrangement to the combination of an even n-number of linearly arranged microphone units and a plurality of adder circuits for summing the outputs of the i-th and $(n-i+1)$-th microphone units, where $1 \leqq i \leqq n/2$. This allows the entire circuitry system to be reduced in size and ensures an improved directional characteristic which has no frequency dependence and causes no change in the sound quality and level when a speaker moves about within the recording area.

Figure 6:
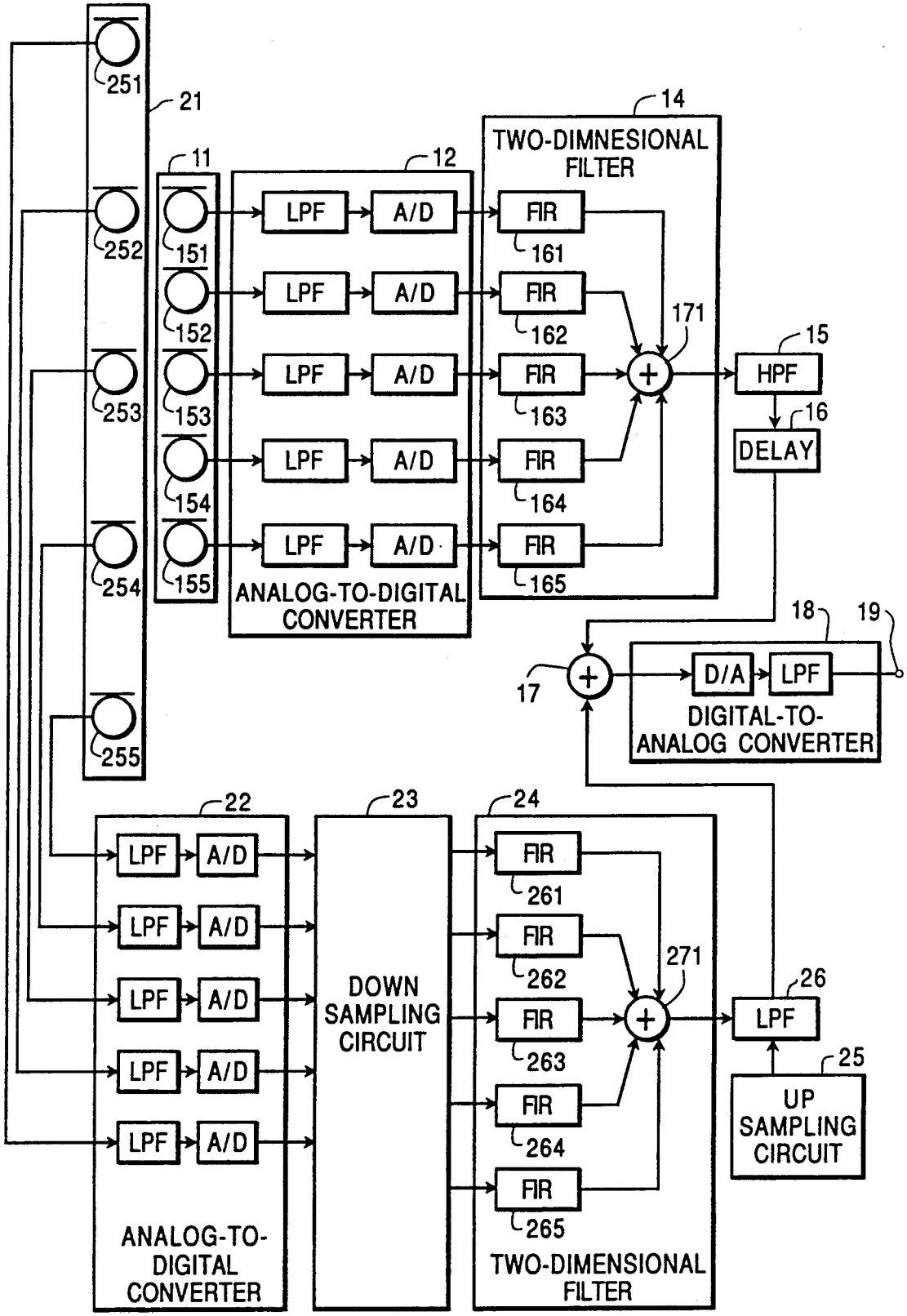
FIG. 6 is a schematic view of an array microphone according to a fourth embodiment of the present invention.

A fourth embodiment of the present invention will be described in the form of an array microphone referring to the accompanying drawings. FIG. 6 illustrates the array microphone according to the fourth embodiment in which elements 151 to 155 are omni-directional microphone units. The omni-directional microphone units 151 to 155 are provided in the linear arrangement constituting a first microphone array 11. Element 12 is an analog-to-digital (A/D) converter circuit which converts analog outputs from the respective omni-directional microphone units 151 to 155 in the microphone array 11 to digital signals. Elements 161 to 165 are FIR filters and element 171 is a first adder circuit. There is a first two-dimensional filter 14 constituted by the FIR filters 161 to 165 for receiving signal outputs from the A/D converter circuit 12 and the first adder circuit 171 for summing signal outputs of the FIR filters 161 to 165 in order to distribute a composite digital signal. Also, a first band limit filter 15 which may be a high-pass filter (HPF) is provided for limiting a given frequency band of the signal transferred from the first adder circuit 171 of the first two-dimensional filter 14. Element 16 is a delay circuit for delaying the output of the first band limit filter 15. Element 251 to 255 are also omni-directional microphone units which are linearly arranged at equal intervals of n times the interval of the omni-directional microphone units 151 to 155 and constitute a second microphone array 21. Element 22 is a second analog-to-digital (A/D) converter circuit for converting analog outputs of the omni-directional microphone units 251 to 255 of the microphone array 21 into digital signals. The sampling frequency of each digital output from the A/D converter circuit 22 is divided into 1/n by a down sampling circuit 23. Elements 261 to 265 are also FIR filters for receiving output signals from the down sampling circuit 23 while 271 is a second adder circuit for summing the signal outputs of the FIR filters 261 to 265. The FIR filters 261 to 265 and the second adder circuit 271 constitute in combination a second two-dimensional filter 24. Furthermore, an up sampling circuit 25 is provided for multiplying by n the sampling frequency of an output derived from the second adder circuit 271 of the second two-dimensional filter 24. Element 26 is a second band limit filter which may be a low-pass filter (LPF) for limiting a particular frequency band of the output of the up sampling circuit 25. There is a third adder circuit 17 for summing the signal outputs of the delay circuit 16 and the second band limit filter 26. Element 18 is a digital-to-analog (D/A) converter circuit for converting the output of the third adder circuit 17 from digital to analog form. Element 19 is a terminal from which the analog output signal is outputted.

The operation of the array microphone having the foregoing arrangement is explained as follows. The outputs of the first microphone array 11 are converted into digital signals by the first A/D converter circuit 12 and then, filtered in the dimensions of both time and space by the first two-dimensional filter 14. The first band limit filter 15 allows a high frequency range of the signal from the first two-dimensional filter 14 to pass. The signal transmitted across the first band limit filter 15 is then delayed by the delay circuit 16 so as to correspond to a low-frequency signal with respect to the time base group delay response which will be described later. The first and second microphone arrays 11 and 21 are arranged in a parallel and co-centering relationship, thus allowing the high and low frequency signals to correspond to each other in the term of spatial group delay response. The outputs of the second microphone array 21 are converted by the second A/D converter circuit 22 into digital signals whose sampling frequency is in turn divided into 1/n by the down sampling circuit 23. The second two-dimensional filter 24 has the same two-dimensional filter coefficient as of the first two-dimensional filter 14 in order to filter the output of the down sampling circuit 23 in the dimensions of time and space. Then, the sampling frequency of the output from the second two-dimensional filter 24 is multiplied by n with the up sampling circuit 25 and its low band only is passed through the second band limit filter 26 to come out as a low frequency signal. The outputs of the delay circuit 16 and the second band limit filter 26 are summed up by the third adder circuit 17 and converted to an analog signal by the D/A converter circuit 18 and output.

According to the fourth embodiment, the improvement comprises a first microphone array including a row of microphone units, a first A/D converter circuit for converting the analog output of each microphone unit into a digital signal, a first two-dimensional filter for filtering the output of the first A/D converter circuit in the dimensions of both time and space, a first band limit filter for limiting a given band of the output from the first two-dimensional filter, a delay circuit for delaying the output of the first band limit filter, a second microphone array including microphone units arranged at intervals of n times the interval of the microphone units of the first microphone array, a second A/D converter circuit for converting the analog output of each microphone unit of the second microphone array into a digital signal, a down sampling circuit for dividing the sampling frequency of an output from the second A/D converter circuit into 1/n, a second two-dimensional filter for filtering the output of the down sampling circuit in the dimensions of both time and space, an up sampling circuit for multiplying by n the sampling frequency of an output from the second two-dimensional filter, a second band limit filter for limiting a given band of the output from the up sampling circuit, an adder circuit for summing the outputs of the delay circuit and the second band limit circuit, and a digital-to-analog converter circuit for converting the digital output of the adder circuit into an analog signal. This arrangement allows the band of frequency to extend and the entire circuitry system to decrease in size as compared with the first embodiment.

What is claimed is:

1. An array microphone comprising:

a microphone array including a plurality of microphone units, and a two-dimensional filter for filtering an output of said microphone array in the dimensions of both time and space at one time;

wherein said microphone array comprises an even n-number of microphone units linearly arranged at equal intervals and an adder circuit for summing up outputs of i-th and $(n-i+1)$-th microphone units, wherein $1 \leqq i \leqq n/2$.

2. An array microphone comprising:

a microphone array including a plurality of microphone units, and a two-dimensional filter for filtering an output of said microphone array in the dimensions of both time and space at one time;

wherein said microphone array comprises an odd n-number of microphone units linearly arranged at equal intervals and an adder circuit for summing up outputs of i-th and $(n-i+1)$-th microphone units, where $1 \leqq i \leqq (n-1)/2$.

3. An array microphone comprising:

a microphone array including a plurality of microphone units;

an analog-to-digital converter circuit for converting an analog output of said microphone array into a digital signal;

a two-dimensional filter for filtering the digital signal from said analog-to-digital converter circuit in the dimensions of both time and space at one time; and a digital-to-analog converter circuit for converting a digital output of said two-dimensional filter into an analog signal;

wherein said microphone array comprises an even n-number of microphone units linearly arranged at equal intervals and an adder circuit for summing up outputs of i-th and $(n-i+1)$-th microphone units, where $1 \leqq i \leqq n/2$.

4. An array microphone comprising:

a microphone array including a plurality of microphone units;

an analog-to-digital converter circuit for converting an analog output of said microphone array into a digital signal;

a two-dimensional filter for filtering the digital signal from said analog-to-digital converter circuit in the dimensions of both time and space at one time; and a digital-to-analog converter circuit for converting a digital output of said two-dimensional filter into an analog signal;

wherein said microphone array comprises an odd n-number of microphone units linearly arranged at equal intervals and an adder circuit for summing up outputs of i-th and $(n-i+1)$-th microphone units, where $1 \leqq i \leqq (n-1)/2$.

5. An array microphone comprising:

a microphone array including a plurality of microphone units;

an analog-to-digital converter circuit for converting an analog output of said microphone array into a digital signal;

a two-dimensional filter for filtering the digital signal from said analog-to-digital converter circuit in the dimensions of both time and space at one time;

a digital-to-analog converter circuit for converting a digital output of said two-dimensional filter into an analog signal; and a sampling frequency control circuit for varying sampling frequencies of said analog-to-digital converter circuit, said two-dimensional filter, and said digital-to-analog converter circuit.

6. An array microphone according to claim 5, wherein said microphone units are arranged linearly.

7. An array microphone according to claim 5, wherein said microphone units are arranged at equal intervals.

8. An array microphone according to claim 5, wherein each of said microphone units is an omni-directional microphone unit.

9. An array microphone according to claim 5, wherein each of said microphone units is a directional microphone unit.

10. An array microphone according to claim 5, further comprising a coefficient change circuit for changing a coefficient of said two-dimensional filter.

11. An array microphone according to claim 5, wherein said two-dimensional filter comprises FIR digital filters for filtering outputs of said microphone units respectively and an adder circuit for summing up outputs of said FIR digital filters.

12. An array microphone comprising:

a first microphone array including a plurality of first microphone units arranged in a row;

a first analog-to-digital converter circuit for converting an analog output of said first microphone array into a digital signal;

a first two-dimensional filter for filtering the digital signal from said first analog-to-digital converter circuit in the dimensions of both time and space at one time;

a first band limit filter for limiting a given band of an output of said first two-dimensional filter;

a delay circuit for delaying an output of the first band limit filter;

a second microphone array including a plurality of second microphone units arranged at intervals of n times an interval of the first microphone units of said first microphone array;

a second analog-to-digital converter circuit for converting an analog output of said second microphone array into a digital signal;

a down sampling circuit for dividing into 1/n a sampling frequency of the digital signal from the second analog-to-digital converter circuit;

a second two-dimensional filter for filtering an output of said down sampling circuit in the dimensions of both time and space at one time;

an up sampling circuit for multiplying by n the sampling frequency of an output of said second two-dimensional filter;

a second band limit filter for limiting a given band of an output of said up sampling circuit;

an adder circuit for summing up outputs of said delay circuit and said second band limit filter; and a digital-to-analog converter circuit for converting an output of said adder circuit into an analog signal.

* * * * *